US008505764B2

(12) United States Patent
Tasaki et al.

(10) Patent No.: US 8,505,764 B2
(45) Date of Patent: Aug. 13, 2013

(54) STRUCTURE OF CLINCH PORTION OF MOUNTING CUP

(75) Inventors: Minoru Tasaki, Tokyo (JP); Sunao Morishita, Tokyo (JP); Kouji Kinoshita, Tokyo (JP); Takaho Kumai, Kawagoe (JP)

(73) Assignees: Toyo Seikan Kaisha, Ltd., Tokyo (JP); Toyo Aerosol Industry Co., Ltd., Tokyo (JP)

( * ) Notice: Subject to any disclaimer, the term of this patent is extended or adjusted under 35 U.S.C. 154(b) by 169 days.

(21) Appl. No.: 12/988,681

(22) PCT Filed: Apr. 17, 2009

(86) PCT No.: PCT/JP2009/058111

§ 371 (c)(1),
(2), (4) Date: Oct. 20, 2010

(87) PCT Pub. No.: WO2009/131198

PCT Pub. Date: Oct. 29, 2009

(65) Prior Publication Data

US 2011/0031255 A1 Feb. 10, 2011

(30) Foreign Application Priority Data

Apr. 25, 2008 (JP) ..... 2008-115234

(51) Int. Cl.
*B65D 6/28* (2006.01)

(52) U.S. Cl.
USPC ..... 220/620; 220/614; 220/689; 215/324; 215/327

(58) Field of Classification Search
USPC ..... 220/614, 619–620, 689, 639–641, 220/378; 222/402.1, 394; 215/324, 327
See application file for complete search history.

(56) References Cited

U.S. PATENT DOCUMENTS

| | | | | |
|---|---|---|---|---|
| 2,117,807 | A * | 5/1938 | Jesser | 220/320 |
| 4,795,045 | A * | 1/1989 | Radtke | 215/325 |
| 4,813,576 | A * | 3/1989 | Greenebaum, II | 222/394 |
| 4,832,236 | A * | 5/1989 | Greaves | 222/402.1 |
| 5,234,137 | A | 8/1993 | Meuresch et al. | |
| 5,406,689 | A * | 4/1995 | Radtke | 29/527.1 |
| 5,765,714 | A * | 6/1998 | Nakano et al. | 220/619 |
| 6,736,283 | B1 * | 5/2004 | Santamaria et al. | 220/619 |
| 7,673,768 | B2 * | 3/2010 | Reed et al. | 220/619 |

FOREIGN PATENT DOCUMENTS

| | | |
|---|---|---|
| JP | 41-11238 B1 | 6/1966 |
| JP | 1990-66259 A | 5/1990 |
| JP | 2004-36691 A | 2/2004 |

* cited by examiner

*Primary Examiner* — Mickey Yu
*Assistant Examiner* — Brijesh V. Patel
(74) *Attorney, Agent, or Firm* — Lucas & Mercanti, LLP; Klaus P. Stoffel

(57) ABSTRACT

The structure of a clinch portion of a mounting cup is provided which can retain a gasket. The clinch portion includes a curl portion continuous with an upper end of an outer circumferential wall at an inner circumferential edge of the curl portion, and a curl skirt portion having an upper end continuous with an outer circumferential edge of the curl portion. The curl portion is made of a plurality of curved planes having different radii extending from the inner circumferential edge to outer circumferential edge. A space a portion of the gasket can enter is formed between a virtual curved plane with a radius constituting the inner plane of the curl portion and an inner curved plane or an outer curved plane, or between the virtual curved plane and both the inner and outer curved planes.

5 Claims, 5 Drawing Sheets

STRUCTURE OF CLINCH PORTION OF MOUNTING CUP

CROSS-REFERENCE TO RELATED APPLICATIONS

This application is a 371 of PCT/JP2009/058111 filed Apr. 17, 2009, which claims the benefit of Japanese Patent Application No. 2008-115234 filed Apr. 25, 2008, the contents of each of which are incorporated herein by reference.

TECHNICAL FIELD

The present invention relates to the structure of a clinch portion of a mounting cup of an aerosol container, the clinch portion clinching a can bead with a gasket being held therebetween.

DESCRIPTION OF RELATED ART

An aerosol container contains the liquid contents in a can tube in a pressured state, and the liquid contents are ejected from a nozzle as a valve stem mounted on a mounting cup is depressed to open a valve.

A mounting cup in a valve mounting state is clinched to a can bead at the apex of a can tube, to seal the mounting cup and can bead with a gasket. Namely, as shown in FIG. 5, a conventional mounting cup 101 is clinched and fixed to a can bead 14 of a container main body by inserting a gasket 34 into a curl portion 107 corresponding to a sealing portion to thereby seal the container main body.

An opening portion of the aerosol can is formed with a can bead directly coupled to an upper end of a can tube, or a can bead is formed in advance on a ceiling lid and the lid is wound at the upper end of the can tube.

A gasket is formed in a shape of a flat circular ring, and is inserted into the curl portion 107 of the mounting cup in a state rotating once around the mounting cup 101. The gasket inserted beforehand in the curl portion of the mounting cup may be clinched at a shifted insertion position, or the position of the gasket may be displaced during clinching. In this case, an extruded portion 110 or a dropout portion is formed, resulting in an exterior defect or a seal defect. It is therefore required to develop a gasket holding technique without position displacement during clinching.

[Patent Document 1] U.S. Pat. No. 5,052,577

[Patent Document 2] U.S. Pat. No. 5,226,573

As the gasket holding technique, a mounting cup seal structure has been developed in which a clinching curl portion is formed not as a curved plane but as a flat plane, and a gasket is inserted in the curl portion to seal the curl portion and a can bead of a can tube. This seal structure is described in Patent Document 1 and Patent Document 2.

DISCLOSURE OF THE INVENTION

Problems to be Solved by the Invention

The seal structure described in Patent Document 1 has a horizontal flat ceiling plate of the curl portion of the mounting cup, and a gasket is inserted in the curl portion in tight contact with the ceiling plate. It is therefore possible to prevent the gasket from being displaced inward or outward along the radial direction when the gasket is clinched, and to narrow a gap between the can bead and the side wall of the mounting cup.

The technique of Patent Document 1 has the effects of preventing extrusion of the gasket because the gasket is in plane contact with the flat ceiling plane of the curl portion. However, since the can bead clinching the gasket has a circular tube shape, there may arise a case in which a pressure force against the gasket rises linearly and does not propagate to the whole gasket uniformly.

The seal structure described in Patent Document 2 has a horizontal flat ceiling plate of the curl portion of the mounting cup, and a gasket is inserted in the curl portion in tight contact with the ceiling plate. It is therefore possible to prevent the gasket from being displaced inward or outward when the gasket is clinched, to facilitate insertion of the mounting cup by forming a gap between the can bead and the side wall of the mounting cup, and to bury the gap with the deformed portion of the gasket at a later clinching process.

Similar to Patent Document 1, the technique of Patent Document 2 applies also a pressure force against the gasket not propagated to the whole gasket, because the ceiling plane of the curl portion of the mounting cup is flat and the inner circumferential wall of the mounting cup is also of a straight circular tube shape.

It has been desired under the above-described circumstance to develop the structure of a curl portion of a mounting cup, which is capable of reliably holding a gasket between the curl portion and a can bead, eliminates extrusion of the gasket, and provides good gasket insertion workability.

The present invention has been made in consideration of the above-described circumstance, and an object of the present invention is to provide the structure of a curl portion of a mounting cup, which is capable of reliably holding a gasket between the curl portion and a can bead, eliminates extrusion of the gasket, and provides a more reliable seal.

Means for Solving the Problems

In order to achieve the above object of the present invention, there is provided a structure of a gasket holding portion of a clinch portion of a mounting cup as a structure of the clinch portion for holding the gasket of the mounting cup to be clinched to a can bead, wherein:

the clinch portion includes a curl portion continuous with an upper end of an outer circumferential wall at an inner circumferential edge of the curl portion, and a curl skirt portion having an upper end continuous with an outer circumferential edge of the curl portion, respectively of the mounting cup and being concentric relative to a center line of the mounting cup;

an inner plane of the curl portion is formed including a curved plane in an inner portion on a side of the inner circumferential edge and a curved plane in an outer portion on a side of the outer circumferential edge; and a space a portion of the gasket can enter is formed between a virtual curved plane with a radius constituting the inner plane of the curl portion and a curved plane in the inner portion and/or a curved plane in the outer portion.

Effects of the Invention

According to the invention described in claim 1, the inner plane of the curl portion is constituted of a plurality of curved planes having different radii, and a space the gasket can enter is prepared between the virtual curved plane and the curved plane in the inner portion and/or outer portion. It is therefore possible to accommodate the gasket and prevent extrusion of the gasket.

According to the invention described in claim 2, the radius of the virtual curved plane is set shorter than the radius of the curved plane of the inner portion and/or outer portion so that the space for accommodating the gasket can be formed easily.

According to the invention described in claim 3, a radius of the curved plane in the outer portion is set different from a radius of the curved plane in the inner portion so that the size and shape of the space for accommodating the gasket become different between the inner and outer portions. It is therefore possible to reliably prevent extrusion of the gasket.

According to the invention described in claim 4, an outer diameter of an upper portion of the outer circumferential wall continuous with the curl portion of the mounting cup is set larger than an outer diameter of a lower portion continuous with the upper portion. When the gasket is inserted and fitted upwards along the outer circumferential wall having a smaller outer diameter, the gasket can be inserted easily and workability is improved since there is a sufficiently marginal clearance.

Since the upper portion of the outer circumferential wall has a larger diameter, a clearance from the inner circumferential plane of the gasket having an annular ring shape is very narrow so that the position of the gasket in the curl portion can be determined precisely.

According to the present invention, the main portion of the inner plane of the curl portion is constituted of a curved plane corresponding to the shape of the can bead. A compression force applied to the gasket by the can bead during a clinching process can be distributed uniformly in the gasket.

BEST MODE FOR CARRYING OUT THE INVENTION

An embodiment of the present invention will now be described with reference to the accompanied drawings.

Figure 1:
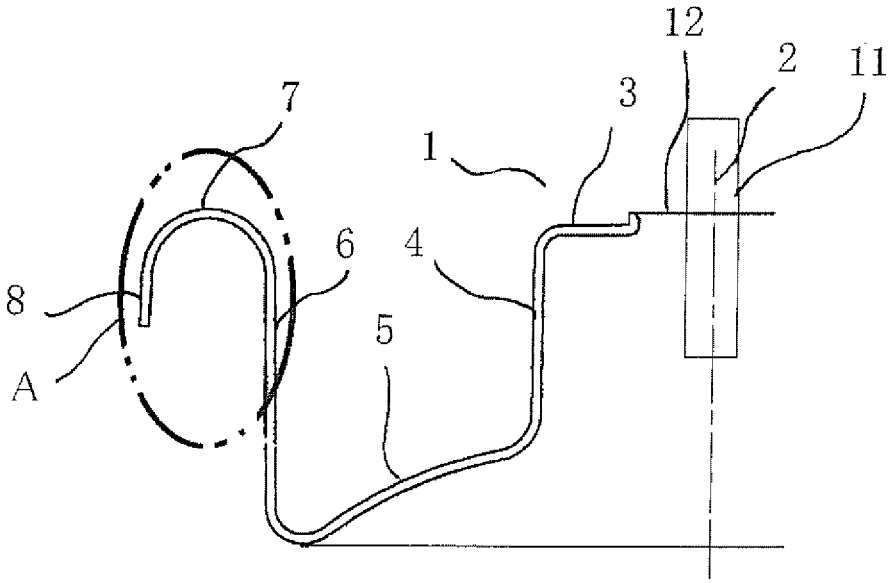
FIG. 1 is a vertical cross sectional view of a mounting cup.

Referring to FIG. 1, reference numeral 1 represents a mounting cup. The mounting cup 1 includes a top plate portion 3, an inner circumferential wall 4, a ring-shaped bottom portion 5, an outer circumferential wall 6, a curl portion 7 and a curl skirt portion 8, respectively from the center side to a peripheral side, around a center line 2. A valve stem 11 to be used for ejecting the contents is disposed in a hole 12 formed through the top plate portion 3.

Figure 2:
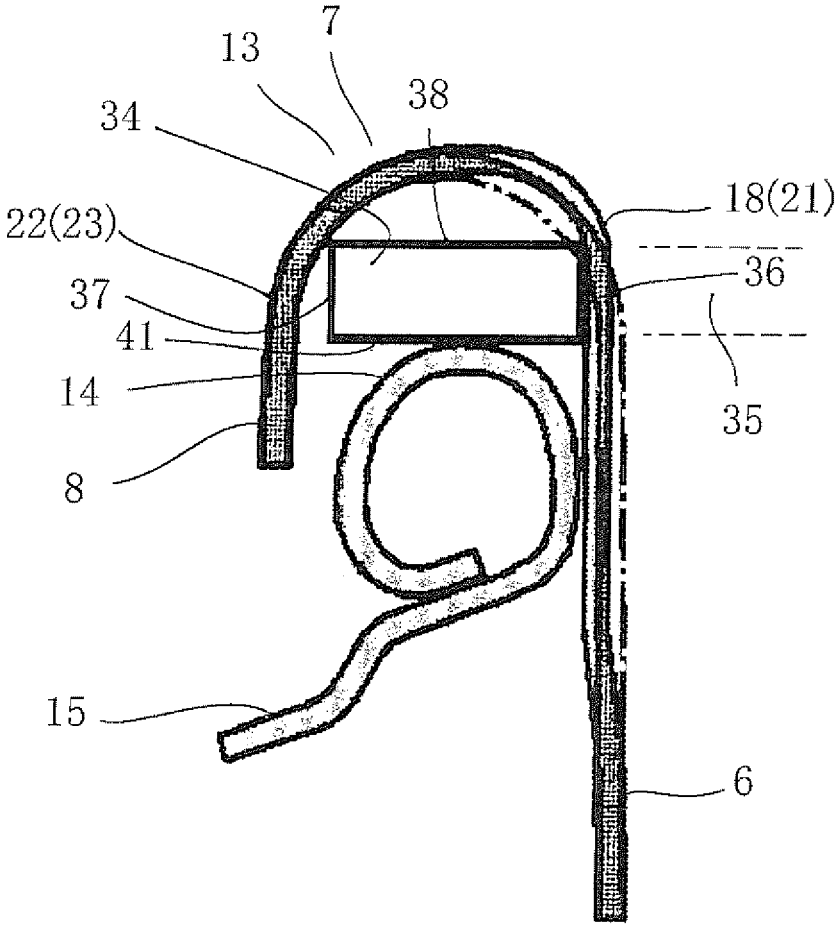
FIG. 2 is an enlarged view of an A portion in FIG. 1.

Referring to FIG. 2, reference numeral 13 represents a clinch portion of the mounting cup 1 of an aerosol container. FIG. 2 illustrates the mounting cup 1 before a clinching process, and a can bead 14 to be clinched by the mounting cup 1. The can bead 14 may be formed directly on an upper end of a can tube, or the can bead may be formed in advance on a ceiling lid 15 and the ceiling lid 15 is wound at the upper end of the can tube. In this embodiment, the can bead 14 is formed at the upper end of the ceiling lid 15.

The clinch portion 13 of the mounting cup 1 is constituted of the outer circumferential wall 6, curl skirt portion 8 and curl portion 7, respectively concentric relative to the center line 2.

An upper end 18 of the outer circumferential wall 6 is continuous with an inner circumferential edge 21 of the curl portion 7, and an upper end 22 of the curl skirt portion 8 is continuous with an outer circumferential edge 23 of the curl portion 7.

Figure 3:
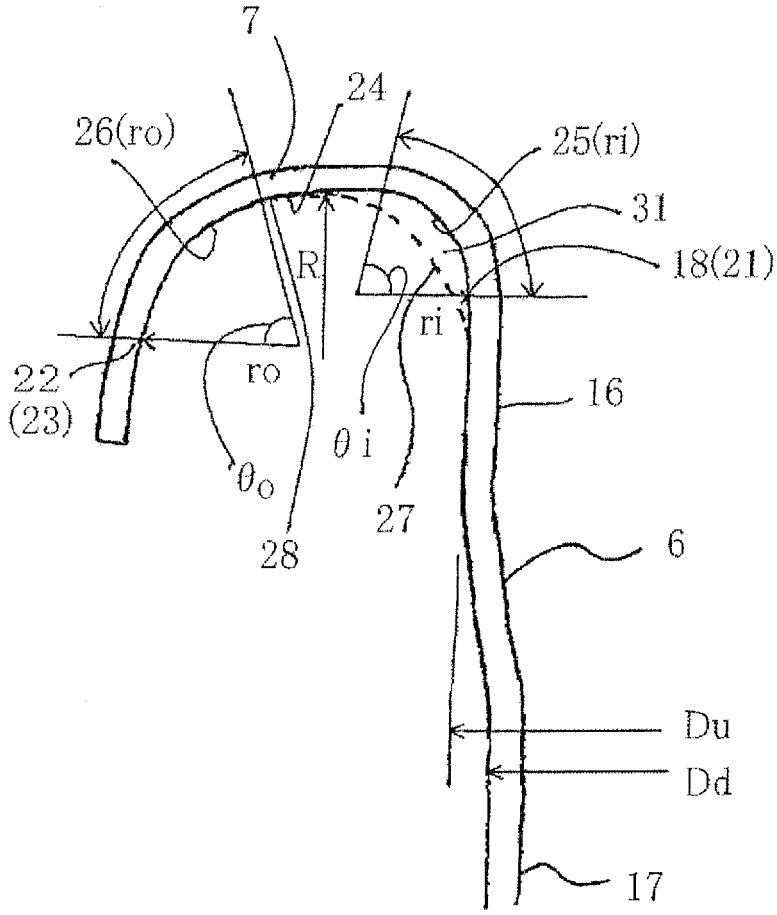
FIG. 3 is a partially enlarged vertical cross sectional view before a clinching step of the present invention.

As illustrated in FIG. 3, the outer circumferential wall 6 is constituted of an upper portion 16 on the side of the curl portion 7, and a lower portion 17 continuous with a lower end of the upper portion 16. The outer diameters of both the portions are different, i.e., an outer diameter Du of the upper portion 16 is larger than an outer diameter Dd of the lower portion 17 (Du>Dd).

An inner plane of the curl portion 7 is a curved plane turning once around the center line 2, and has a cross sectional shape of a curved plane constituting a curved line over the whole area from the inner circumferential edge 21 to outer circumferential edge 23, on a flat plane including the center line 2. This curved plane is constituted of a plurality of curved planes having different radii in respective portions along the radial direction of the mounting cup 1.

In this embodiment, the curved plane is constituted of a curved plane 25 having a radius of ri in an inner portion on the side of the inner circumferential edge 21, a curved plane 26 having a radius of ro in an outer portion on the side of the outer circumferential edge 23, and a curved plane 24 in an intermediate portion between the curved plane 25 and curved plane 26. The inner plane 28 of the curled portion 7 is a curved plane constituting a curve as a whole, and this curved plane is constituted of two curved planes, or if necessary, a plurality of curved planes. In this embodiment, this curved plane is constituted of three types of curved planes including the curved plane 24, curved plane 25 having the radius of ri, and curved plane 26 having the radius of ro.

A space 31 a portion of a gasket can enter can therefore be formed between the curved plane 25 in the inner portion and a virtual curved plane 27 constituting the inner plane of the curl portion 7 at a single radius R. This space 31 can be formed, for example, by setting the radius ri of the curved plane 25 in the inner portion smaller than the radius R of the virtual curved plane 27 (ri<R).

In addition to the space 31, another space may be formed, if necessary, on the side of the outer circumferential edge 23 of the curl portion 7. This space on the side of the outer circumferential edge is formed between the virtual curved plane 27 and the curved plane 26 in the outer portion.

This space on the outer side is realized, for example, by setting the radius ro of the curved plane 26 in the outer portion smaller than the radius R of the virtual curved plane 27 (ro<R). If both the outer and inner spaces are formed, the radius ri of the curved plane 25 in the inner portion and the radius ro of the curved plane 26 in the outer portion are made different (ri≠ro) to effectively hold the gasket in the curl portion 7 without position displacement.

An operation of clinching the mounting cup constructed as above to the can bead 14 and the operation of the mounting cup are as follows.

First, as illustrated in FIG. 2, the gasket 34 is inserted into the curl portion 7 of the mounting cup 1.

The gasket 34 has a circular ring shape constituted of a hole 35, an inner circumferential plane 36, an outer circumferential plane 37, an upper flat plane 38 and a lower flat plane 41. The hole 35 is fitted in the cup from the lower end of the outer circumferential wall 6. Since the lower portion 17 of the outer circumferential wall 6 has a smaller diameter than that of the upper portion 16, the hole can be fitted easily in the cup.

As the gasket 34 fitted in the lower portion 17 is moved upward, the gasket reaches the upper half 16 having a larger diameter so that there is no clearance between the inner circumferential plane 36 of the gasket 34 and the upper portion 16. The gasket 34 is therefore inserted into the curl portion 7 in a correctly position-aligned state (refer to FIGS. 2 and 3).

The mounting cup 1 with the gasket 34 being inserted into the curl portion 7 is placed on the can bead 14. Also in this case, since the lower portion 17 of the outer circumferential wall 6 has a smaller diameter, the can bead 14 can be easily inserted into the inner circumferential portion. Further, since a clearance is small between the upper portion 16 of the outer circumferential wall 6 having the larger diameter and the can bead 14, an axial displacement between the mounting cup 1 and can bead 14 occurs hardly and it is possible to prevent the gasket 34 from being moved during adjustment of an axial displacement.

Figure 4:
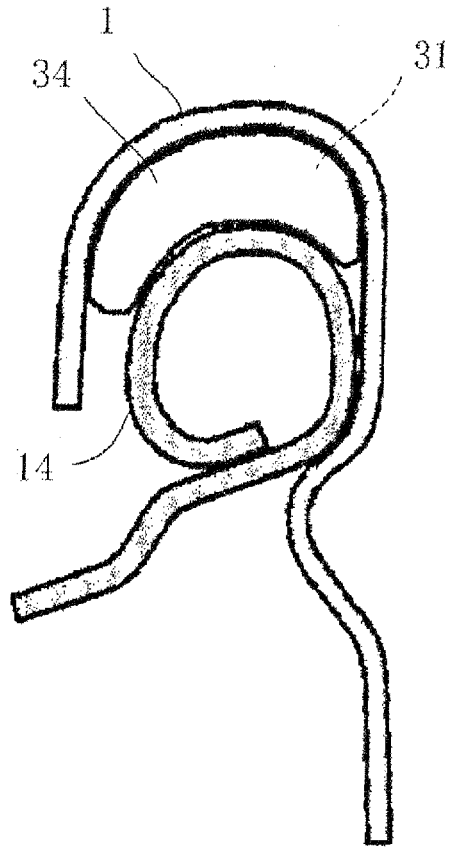
FIG. 4 is a partially enlarged vertical cross sectional view of a clinch portion of the present invention.
Figure 5:
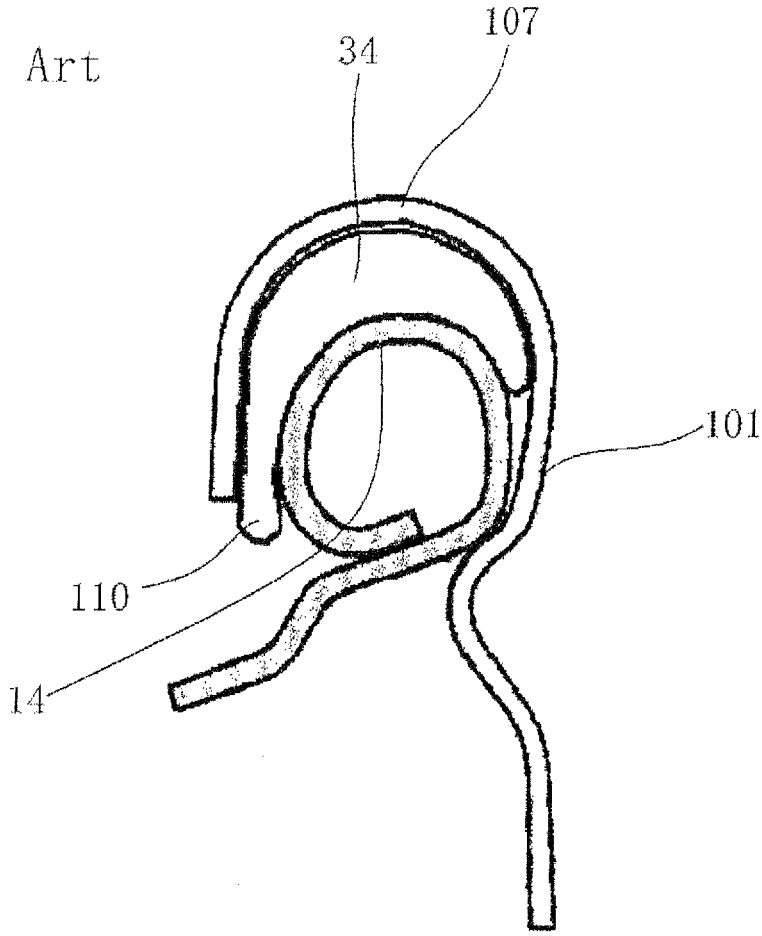
Fig. 5 Prior Art
FIG. 5 is a partially enlarged vertical cross sectional view of a clinch connection of the prior art.

The mounting cup 1 placed on the can bead 14 is then clinched to the can bead 14 by a clinching process (refer to FIG. 4).

In this clinching process, the gasket 34 is compressed between the curl portion 7 and can bead 14, and partially enters the space 31 formed near the inner circumferential edge 21 of the curl portion 7 and/or the space formed near the outer circumferential edge 23 of the curl portion 7. This partial entrance functions as an anchor resistant to displacement of the gasket. In this manner, the gasket is prevented from being displaced, and is held between the curl portion 7 and can bead 14.

The curved planes of the curl portion of the mounting cup 1 constructed as above and formed between the inner and outer circumferential edges along the radial direction perpendicular to the center line 2 have different radii. Therefore, the size and shape of the spaces for accommodating the gasket become different between inner and outer portions so that the gasket can be prevented from extruding. Further, since the main portion of the curl portion is constituted of curved planes corresponding to the shape of the can bead, the gasket can be pressurized uniformly in a broad area and a more reliably seal can be obtained.

Various size relations suitable for preventing displacement of the gasket of the mounting cup have been studied, and it has been found that the following size relations provide remarkable effects.

(1) Shape of Inner Plane of Curl Portion

The virtual curved plane 27 corresponds approximately to a conventional curl portion shape, and the curved plane 25 in the inner portion of the present application has preferably the radius ri which is 40 to 80% the radius R of the virtual curved plane 27.

As specific numerical values, a preferable range of the radius ri is 0.6 mm≦R≦1.3 mm if a curl portion molding jig shape for the current products has the radius R=1.6 mm.

If a space is not formed in the outer portion, the radius ro of the curved plane 26 in the outer portion is preferably similar to a conventional example (ro is nearly R), because mount performance on the can bead 14 is not adversely affected.

A plane defined by the upper end of the curl skirt portion 8 (=outer circumferential edge 23 of the curl portion 7), curved plane 26 in the outer portion having the radius ro, curved plane 25 in the inner portion having the radius ri, and upper end of the outer circumferential wall 6 (=inner circumferential edge 21 of the curl portion 7) may be smoothly coupled by proper curved planes or flat planes. In the embodiment described above, the curved planes 26 and 25 are coupled by the intermediate curved plane 24.

(2) Clearance from Inner Diameter of Can Bead

A clearance from the inner diameter of the can bead at a corresponding position of the curl portion is set as narrow as possible. More specifically, a clearance is set preferably to about 0.05 to 0.20 mm and more preferably to about 0.05 to 0.10 mm.

The curved plane 25 (radius ri) in the inner portion on the side of the inner circumferential edge 21 is preferably formed to position the outer end in a range (θi) of 70 to 90° as measured from the inner circumferential edge 21, whereas the curved plane 26 (radius ro) in the outer portion on the side of the outer circumferential edge 23 is preferably formed to position the inner end outer than the curved plane 25 and at (θo) equal to or larger than 45° as measured from the outer circumferential edge 23.

As apparent from the foregoing description, according to the present invention, the mounting cup can be obtained by which the gasket can be held reliably between the curl portion and can bead without any extrusion of the gasket, and which has good workability of inserting the gasket.

First Embodiment

A mounting cup having the shape shown in FIG. 2 was manufactured and a gasket and a valve stem were mounted. The mounting cup was made of a tinned plate having a thickness of 0.3 mm, and the sizes were set as follows: a radius ri of the curved plane in the inner portion was 1.0 mm; a radius ro of the curved plane in the outer portion was 1.6 mm; a diameter Du of the upper portion of the outer circumferential wall was 25.3 mm, a diameter Dd of the lower portion of the outer circumferential wall was 25.0 mm.

Propellant was filled in an aerosol can main body having a can bead inner diameter of 1 inch (25.4 mm), and the manufactured mounting cup was clinched to the aerosol can and sealed. In this case, in order to make it easy to extrude a gasket, a clinch load larger than an ordinary load was applied. There was no leak of propellant from the clinch portion. Extrusion of the gasket was evaluated in three degrees, large, middle and small, by visual observation in a lateral direction at the lower end of the curl skirt portion after clinch. This clinch test was conducted for 100 cans, and the test results are represented by Table 1.

First Comparative Example

A mounting cup having a conventional shape was manufactured by using the same tinned plate, and the sizes were set as follows: a radius of the inner plane of the curl portion was 1.6 mm (curved plane having a single radius); and a diameter of the outer circumferential wall was 25.0 mm (no step). Similar to the first embodiment, a clinch load larger than an ordinary load was applied, and a clinch test was conducted for 100 cans. There was no leak of propellant from the clinch portion. Evaluation results are represented by Table 1.

TABLE 1

| | Ratio of gasket extrusion (%) | | | |
|---|---|---|---|---|
| | Large | Middle | Small | Total |
| First Embodiment | 0 | 0 | 0 | 0 |
| First Comparative Example | 1 | 3 | 8 | 12 |

The technical scope of the invention is not limited to the embodiment.

DESCRIPTION OF REFERENCE NUMERALS

1 . . . mounting cup, 2 . . . center line, 3 . . . top plate portion, 4 . . . inner circumferential wall, 5 . . . ring-shaped bottom portion, 6 . . . outer circumferential wall, 7 . . . curl portion, 8 . . . curl skirt portion, 11 . . . valve stem, 12 . . . hole, 13 . . . clinch portion, 14 . . . can bead, 15 . . . ceiling lid, 16 . . . upper portion, 17 . . . lower portion, 18 . . . upper end of outer circumferential wall, 21 . . . inner circumferential edge, 22 . . . upper end of curl skirt portion, 23 . . . outer circumferential edge, 24 . . . curved plane in intermediate portion, 25 . . . curved plane in inner portion, 26 . . . curved plane in outer portion, 27 . . . virtual curved plane, 28 . . . inner plane in curl portion, 31 . . . space, 34 . . . gasket, 35 . . . hole, 36 . . . inner circumferential plane, 37 . . . outer circumferential plane, 38 . . . upper flat plane, 41 . . . lower flat plane, 101 . . . mounting cup, 107 . . . curl portion, 110 . . . extruded portion

The invention claimed is:

1. A structure of a clinch portion of a mounting cup for holding a gasket of said mounting cup clinching a can bead, wherein:

said clinch portion includes a curl portion continuous with an upper end of an outer circumferential wall at an inner circumferential edge of said curl portion, and a curl skirt portion having an upper end continuous with an outer circumferential edge of said curl portion, respectively of said mounting cup and being concentric relative to a center line of said mounting cup;

an inner plane of said curl portion is formed including a curved plane in an inner portion on a side of said inner circumferential edge and a curved plane in an outer portion on a side of said outer circumferential edge; and a space, into which a portion of said gasket can enter, is formed between a virtual curved plane with a single radius constituting the inner plane of said curl portion and said curved plane in said inner portion or said curved plane in said outer portion, wherein a radius of said curved plane in said inner portion or a radius of said curved plane in said outer portion is set differently from the radius of said virtual curved plane, wherein the radius of said curved plane in said inner portion is 40-80% of the radius of said virtual curved plane.

2. The structure of a clinch portion of said mounting cup according to claim 1, wherein a radius of said curved plane in said inner portion or said outer portion is set shorter than the radius of said virtual curved plane.

3. The structure of a clinch portion of said mounting cup according to claim 1, wherein a radius of said curved plane in said outer portion is different from a radius of said curved plane in said inner portion.

4. The structure of a clinch portion of said mounting cup according to claim 1, wherein an outer diameter of an upper portion of said outer circumferential wall on a side of said curl portion is set larger than an outer diameter of a lower portion continuous with the upper portion to narrow a clearance between said upper portion and said can bead.

5. The structure of a clinch portion of the mounting cup according to claim 1, wherein said gasket is formed as a flat circular ring.

* * * * *

UNITED STATES PATENT AND TRADEMARK OFFICE

CERTIFICATE OF CORRECTION

PATENT NO. : 8,505,764 B2
APPLICATION NO. : 12/988681
DATED : August 13, 2013
INVENTOR(S) : Tasaki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 170 days.

Signed and Sealed this
Fifteenth Day of September, 2015

Michelle K. Lee

Michelle K. Lee
*Director of the United States Patent and Trademark Office*